US012392500B2

(12) United States Patent
Zhou et al.

(10) Patent No.: US 12,392,500 B2
(45) Date of Patent: Aug. 19, 2025

(54) KITCHEN AIR CONDITIONER AND CONTROL METHOD THEREOF

(71) Applicant: Guangdong Giwee Technology Co. Ltd., Foshan (CN)

(72) Inventors: Min Zhou, Foshan (CN); Huandi Yang, Foshan (CN); Qing Liu, Foshan (CN); Yaosheng Tan, Foshan (CN)

(73) Assignee: GUANGDONG GIWEE TECHNOLOGY CO. LTD., Foshan (CN)

( * ) Notice: Subject to any disclaimer, the term of this patent is extended or adjusted under 35 U.S.C. 154(b) by 687 days.

(21) Appl. No.: 17/678,566

(22) Filed: Feb. 23, 2022

(65) Prior Publication Data

US 2022/0268448 A1 Aug. 25, 2022

(51) Int. Cl.
*F24C 15/20* (2006.01)
*F24F 5/00* (2006.01)

(52) U.S. Cl.
CPC ..... *F24C 15/2021* (2013.01); *F24F 5/0096* (2013.01); *F24F 2221/18* (2013.01)

(58) Field of Classification Search
CPC .. F24F 11/84; F24F 1/00; F24F 1/0035; F24F 2221/18; F24F 2221/12; F24F 5/0096; F24F 2140/00; F24F 11/34; F24F 11/35; F24F 11/70; F24F 5/96; H01H 2231/012; H01H 67/00; F24C 15/2021
USPC ..... 126/89, 299; 454/333, 258
See application file for complete search history.

(56) References Cited

U.S. PATENT DOCUMENTS 4,352,349 A * 10/1982 Yoho ..... F24C 15/2021 126/299 R
2019/0024929 A1* 1/2019 Funada ..... F24F 11/89
2019/0195523 A1* 6/2019 Mowris ..... F24F 11/61
2019/0234638 A1* 8/2019 Song ..... F24F 11/62
2021/0325058 A1* 10/2021 Yu ..... F24F 1/0011

FOREIGN PATENT DOCUMENTS

CN 102418966 A 4/2012
CN 103940061 A 7/2014
CN 204043061 U 12/2014
CN 104566768 A 4/2015
CN 105241021 A 1/2016
CN 107044664 A 8/2017
CN 107228428 A 10/2017
CN 207487037 U 6/2018
(Continued)

OTHER PUBLICATIONS

European Search Report for application EP 22158577.1, Jul. 7, 2022, 10 pages.

*Primary Examiner* — Edelmira Bosques
*Assistant Examiner* — Michael James Giordano
(74) *Attorney, Agent, or Firm* — CANTOR COLBURN LLP

(57) ABSTRACT

A kitchen air conditioner and a control method thereof, where the kitchen is equipped with a range hood, the air conditioner including a housing and a current detection device. An electric control board is disposed in the housing, and the current detection device is disposed outside the housing and electrically connected to the electric control board. The current detection device is used for detecting a current of the range hood and determining whether the range hood works.

6 Claims, 1 Drawing Sheet

(56) References Cited

FOREIGN PATENT DOCUMENTS

| | | | | | |
|---|---|---|---|---|---|
| CN | 110107980 | A | | 8/2019 | |
| CN | 111630615 | A | * | 9/2020 | ..... H01F 27/2823 |
| CN | 112146214 | A | | 12/2020 | |
| CN | 112178890 | A | | 1/2021 | |
| GB | 2563008 | A | * | 12/2018 | ..... B60H 1/00735 |
| WO | 2019119473 | A1 | | 6/2019 | |

* cited by examiner

KITCHEN AIR CONDITIONER AND CONTROL METHOD THEREOF

FOREIGN PRIORITY

This application claims priority to Chinese Patent Application No. 202110209978.9, filed Feb. 24, 2021, and all the benefits accruing therefrom under 35 U.S.C. § 119, the contents of which in its entirety are herein incorporated by reference.

TECHNICAL FIELD OF INVENTION

The present invention relates to the field of air conditioning technology, and in particular to a kitchen air conditioner and a control method thereof.

BACKGROUND OF THE INVENTION

Existing ducted kitchen air conditioners generally use return air in the kitchen. Due to a large amount of oil fume in the kitchen, the evaporator in the kitchen air conditioner is likely to be clogged when the air conditioner runs for a long period of time, resulting in reduction in performance. More seriously, no wind comes out from the conditioner, causing a unit failure. Some kitchen air conditioners adopt a fresh air return design, which can solve the oil fouling problem of the evaporator. However, the air pressure in the kitchen rises due to the indoor air supply, causing that no wind comes out from the conditioner; and moreover, the related design and control is complicated. Currently, there is an integrated control technology of the kitchen air conditioner and a range hood from the same manufacturer. However, general users purchase the range hood and the kitchen air conditioner separately, or general users in the inventory market have installed the range hood and may purchase the kitchen air conditioner in future. The non-integrated range hood and kitchen air conditioner cannot be linked, that is, cannot automatically adjust the return air inlet of the air conditioner according to the status of the range hood, thus having a low degree of intelligence.

SUMMARY OF THE INVENTION

The main objective of the present invention is to provide a kitchen air conditioner and a control method thereof, so as to solve the technical problem that the non-integrated range hood and kitchen air conditioner cannot be linked, that is, cannot automatically adjust the return air inlet of the air conditioner according to the status of the range hood.

To achieve the foregoing objective, the present invention adopts the following technical solution: A kitchen air conditioner is provided, the kitchen being equipped with a range hood, the air conditioner including: a housing, in which an electric control board is disposed; and a current detection device disposed outside the housing and electrically connected to the electric control board, where the current detection device is used for detecting a current of the range hood and determining whether the range hood works, where the electric control board controls a working status of the air conditioner according to whether the range hood works.

Further, a return air inlet is provided on the housing, and includes a first return air inlet and a second return air inlet; the first return air inlet is used for the air that enters the kitchen, and the second return air inlet leads to the outside of the kitchen through an air duct and is used for introducing the outdoor air.

Further, a first air valve is disposed in the first return air inlet and is electrically connected to the electric control board; a second air valve is disposed in the second return air inlet and is electrically connected to the electric control board; a temperature measurement device for measuring the temperature at the second return air inlet is disposed on a sidewall of the second return air inlet, and is electrically connected to the electric control board; and the temperature measurement device is a temperature probe.

Further, the current detection device is an annular current transformer 3 sleeved on a power line of the range hood.

The present invention further provides a control method of a kitchen air conditioner, applied to the above-described kitchen air conditioner, where the control method includes: acquiring, by the electric control board, a current of the power line of the range hood that is induced by the annular current transformer 3 in a set time; determining, by the electric control board according to the current of the power line induced by the annular current transformer 3, whether the range hood works; and controlling, by the electric control board according to whether the range hood works, a working status of the air conditioner.

Further, a return air inlet is provided on the housing of the air conditioner, and includes a first return air inlet and a second return air inlet; the first return air inlet is used for the air that enters the kitchen, and the second return air inlet leads to the outside of the kitchen through an air duct and is used for introducing the outdoor air; and before the step of acquiring, by the electric control board, the current of the power line of the range hood that is induced by the annular current transformer 3 in the set time, the method includes: when the air conditioner stands by, controlling, by the electric control board, the first air valve and the second air valve to close.

Further, a first air valve is disposed in the first return air inlet and is electrically connected to the electric control board; a second air valve is disposed in the second return air inlet and is electrically connected to the electric control board; a temperature measurement device for measuring the temperature at the second return air inlet is disposed on a sidewall of the second return air inlet, and is electrically connected to the electric control board; and the temperature measurement device is a temperature probe; the step of determining, by the electric control board according to the current of the power line induced by the annular current transformer 3, whether the range hood works includes: determining whether the current induced by the annular current transformer 3 in the set time is less than a set value; and if the current is less than the set value, determining that the range hood does not work; the step of controlling, by the electric control board according to whether the range hood works, a working status of the air conditioner includes: if the range hood does not work, controlling, by the electric control board, the first air valve to open, so that the first return air inlet returns air; and controlling a motor of the air conditioner to work and a compressor of the air conditioner to implement refrigeration after a preset time.

Further, the step of determining, by the electric control board according to the current of the power line induced by the annular current transformer 3, whether the range hood works includes: determining whether the current induced by the annular current transformer 3 in the set time is greater than or equal to a set value; and if the current is greater than or equal to the set value, determining that the range hood works; the step of controlling, by the electric control board according to whether the range hood works, a working status of the air conditioner includes: if the range hood works, controlling, by the electric control board, the second air valve to open, so that the second return air inlet returns air; and controlling the motor of the air conditioner to work.

Further, after the step of controlling, by the electric control board according to whether the range hood works, a working status of the air conditioner, the method includes: acquiring, by the electric control board, the temperature at the second return air inlet measured by the temperature probe; determining whether the temperature at the second return air inlet is less than a set minimum value; and if the temperature at the second return air inlet is less than the set minimum value, controlling, by the electric control board, the compressor to keep in a non-working status.

Further, after the step of controlling, by the electric control board according to whether the range hood works, a working status of the air conditioner, the method includes: acquiring, by the electric control board, the temperature at the second return air inlet measured by the temperature probe; determining whether the temperature at the second return air inlet is between set minimum and maximum values; and if the temperature at the second return air inlet is between the set minimum and maximum values, controlling, by the electric control board after the set time, the compressor of the air conditioner to implement refrigeration.

Further, after the step of controlling, by the electric control board according to whether the range hood works, a working status of the air conditioner, the method includes: acquiring, by the electric control board, the temperature at the second return air inlet measured by the temperature probe; determining whether the temperature at the second return air inlet is greater than a set maximum value; and if the temperature at the second return air inlet is greater than the maximum value, controlling, by the electric control board, the second air valve to close and the first air valve to open, so that the first return air inlet returns air; and after the set time, controlling, by the electric control board, the compressor of the air conditioner to implement refrigeration.

Beneficial effects: In the present invention, the electric control board determines, according to a current signal of the range hood output by the current detection device, whether the range hood works; and further controls a working status of the air conditioner according to whether the range hood works, thus achieving linkage between the range hood and the air conditioner.

MEANING OF NUMERALS

100. Air conditioner; 1. Housing; 11. First return air inlet; 12. First air valve; 13. Second return air inlet; 14. Second air valve; 15. Temperature probe; 2. Range hood; 21. Power line; 3. Annular current transformer The realization, functional characteristics, and advantages of the objective of the present invention will be further described with reference to the accompanying drawings in combination with the embodiments.

DETAILED DESCRIPTION OF THE INVENTION

It should be understood that the specific embodiments described herein are merely used to explain the present invention, but not intended to limit the present invention.

The technical solution in the embodiments of the present invention is clearly and completely described below with reference to the accompanying drawings in the embodiments of the present invention. Apparently, the described embodiments are some rather than all of the embodiments of the present invention. Based on the described embodiments of the present invention, other embodiments acquired by those of ordinary skill in the art without creative effort all belong to the protection scope of the present invention.

It should be noted that, the terms "one end", "the other end", "first", "second", and similar expressions used herein are for illustrative purposes only and should not be construed as indicating or implying relative importance.

The technical solutions between the various embodiments in the embodiments of the present invention may be combined with each other, but must be based on the realization by those of ordinary skill in the art. When the combination of the technical solutions has contradictions or cannot be realized, it shall be considered that such combination of the technical solutions does not exist and is not within the protection scope of the present invention.

Figure 1:
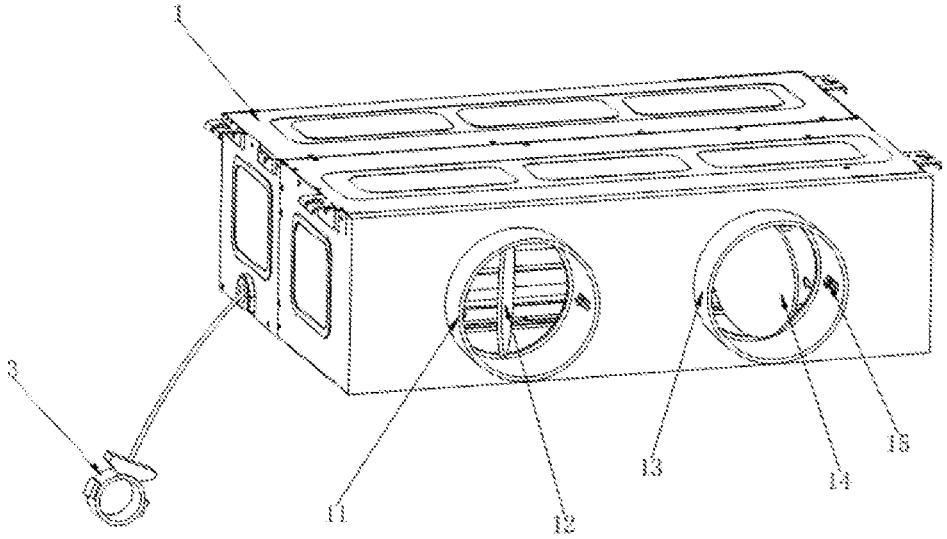
FIG. 1 is a schematic structural diagram of an air conditioner in an embodiment of the present invention.
Figure 2:
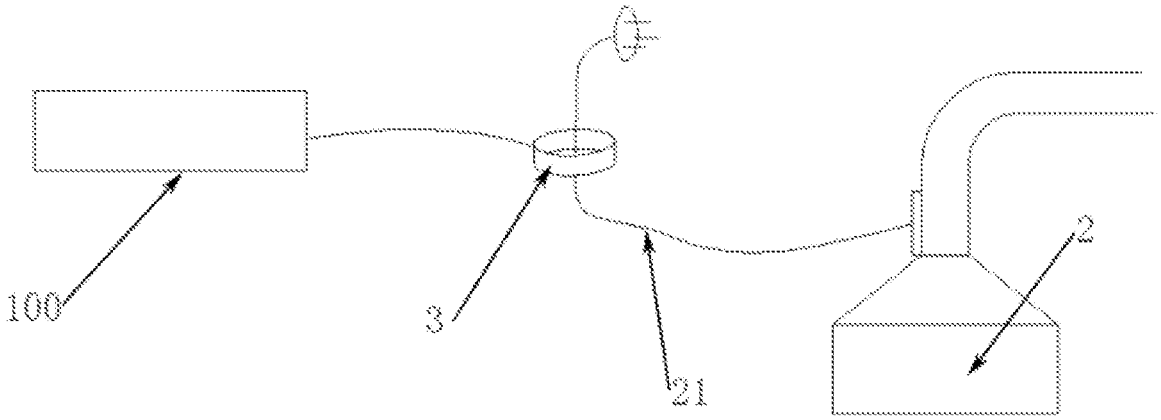
FIG. 2 is a schematic assembled structural diagram of an air conditioner and a range hood in an embodiment of the present invention.

Referring to FIGS. 1 and 2, a kitchen air conditioner in an embodiment of the present invention is provided, the kitchen being equipped with a range hood 2, the air conditioner including: a housing 1, in which an electric control board is disposed; and a current detection device disposed outside the housing 1 and electrically connected to the electric control board, where the current detection device is used for detecting the current of the range hood 2 and determining whether the range hood works.

The electric control board controls a working status of the air conditioner according to whether the range hood 2 works.

In the foregoing embodiment, the electric control board determines, according to a current signal of the range hood that is output by the current detection device, whether the range hood 2 works; and controls, according to whether the range hood 2 works, the working status of the air conditioner. When determining, according to the current signal, that the range hood 2 works, the electric control board controls a motor in the air conditioner to work, thus achieving linkage between the range hood 2 and the kitchen air conditioner.

In an embodiment, a return air inlet is provided on the housing, where the return air inlet includes a first return air inlet 11 and a second return air inlet 13. The first return air inlet 11 is used for the air that enters the kitchen, and the second return air inlet 13 leads to the outside of the kitchen through an air duct and is used for introducing the outdoor air.

In the foregoing embodiment, the return air inlet functions as an air circulation entrance in the kitchen; and the return air inlet of the air conditioner is used for air return, and returns some air into an air conditioning cabinet through the air duct. Under a fixed indoor load, the amount of cold air that needs to be sent into the kitchen is fixed. The second return air inlet 13 leads to the outside of the kitchen through the air duct and is used for introducing the outdoor air, thus reducing the air pressure in the kitchen. After the indoor air is mixed with a small amount of fresh air, cold air is made and is then sent into the kitchen. When the temperature in the kitchen is not too high, the fresh air introduced through the second return air inlet 13 can be directly used for refrigeration, without the need to use a compressor for refrigeration, thus achieving an energy saving effect. The first return air inlet 11 is used for the air that enters the kitchen and realizes circulation of a gas flow in the kitchen.

In an embodiment, a first air valve 12 is disposed in the first return air inlet 11 and is electrically connected to the electric control board; and a second air valve 14 is disposed in the second return air inlet 13 and is electrically connected to the electric control board. A temperature measurement device for measuring the temperature at the second return air inlet 13 is disposed on a sidewall of the second return air inlet 13, and is electrically connected to the electric control board. The temperature measurement device is a temperature probe 15.

In the foregoing embodiment, when the first air valve 12 is opened, the first return air inlet 11 returns air; and when the second air valve 14 is opened, the second return air inlet 13 returns air. The first air valve 12 and the second air valve 14 are both electrically connected to the electric control board, and the electric control board controls opening and closing of the first air valve 12 and the second air valve 14 according to a signal output by the temperature measurement device, so that the first return air inlet 11 and the second return air inlet 13 alternately return air.

A temperature probe 15 is disposed on the sidewall of the first return air inlet 11 and is used for measuring the temperature at the first return air inlet 12.

In the foregoing embodiment, the temperature probe 15 has a small size and thus is easily mounted on the sidewall of the second return air inlet 13. The second return air inlet 13 leads to the outside of the kitchen through the air duct and is used for introducing the outdoor air. The temperature probe 15 is mounted on the sidewall of the second return air inlet 13 and used for measuring the temperature of the outdoor air that enters from the second return air inlet 13.

In an embodiment, the current detection device is an annular current transformer 33 sleeved on a power line 21 of the range hood 2.

In the foregoing embodiment, the annular current transformer 33 can measure the current; is ring-shaped and can be sleeved on the power line 21; and is used for measuring the current magnitude of the power line 21. The annular current transformer 33 is electrically connected to the electric control board; and the electric control board determines, according to the current magnitude of the power line 21 measured by the annular current transformer 33, whether the range hood 2 works.

A control method of a kitchen air conditioner in an embodiment of the present invention is further provided, which is applied to the above-described kitchen air conditioner 100. The control method includes the following steps: acquiring, by the electric control board, a current of the power line 21 of the range hood 2 that is induced by the annular current transformer 33 in a set time; determining, by the electric control board according to the current of the power line 21 induced by the annular current transformer 33, whether the range hood 2 works; and controlling, by the electric control board according to whether the range hood 2 works, a working status of the air conditioner 100.

In the foregoing embodiment, the current passes through the power line 21 in a power-on status, and changes in magnitude within a range. The electric control board determines, according to the current magnitude, whether the range hood 2 works; and controls, according to the working status of the range hood 2, a motor and a compressor in the air conditioner 100 to work or not and further controls one of the return air inlets of the air conditioner 100 to return air.

In an embodiment, a return air inlet is provided on the housing, where the return air inlet includes a first return air inlet 11 and a second return air inlet 13. The first return air inlet 11 is used for the air that enters the kitchen, and the second return air inlet 13 leads to the outside of the kitchen through an air duct and is used for introducing the outdoor air.

Before the step of acquiring, by the electric control board, the current of the power line of the range hood 2 that is induced by the annular current transformer 33 in the set time, the method includes: when the air conditioner 100 stands by, closing the first air valve 12 and the second air valve 14.

In the foregoing embodiment, when the air conditioner 100 stands by, the return air inlet functions as an air circulation entrance in the kitchen. When the air conditioner does not work, it is not required to circulate the air in the kitchen through the return air inlet.

In the foregoing embodiment, before the air conditioner 100 is turned on, both the first air valve 12 and the second air valve 14 are in a closed state. While the annular current transformer 33 induces the current of the power line 21, the temperature probe 13 synchronously measures the temperature at the second return air inlet 13.

In an embodiment, a first air valve 12 is disposed in the first return air inlet 11 and is electrically connected to the electric control board; and a second air valve 14 is disposed in the second return air inlet 13 and is electrically connected to the electric control board. A temperature measurement device for measuring the temperature at the second return air inlet 13 is disposed on a sidewall of the second return air inlet 13, and is electrically connected to the electric control board. The temperature measurement device is a temperature probe 15.

The step of determining, by the electric control board according to the current of the power line 21 induced by the annular current transformer 33, whether the range hood 2 works includes: determining whether the current induced by the annular current transformer 33 in the set time is less than a set value; and if the current is less than the set value, determining that the range hood 2 does not work.

The step of controlling, by the electric control board according to whether the range hood 2 works, a working status of the air conditioner 100 includes: if the range hood 2 does not work, controlling, by the electric control board, the first air valve 12 to open, so that the first return air inlet 11 returns air; and controlling the motor of the air conditioner 100 to work and the compressor of the air conditioner 100 to implement refrigeration after a preset time.

In the foregoing embodiment, the current passes through the power line 21 in a power-on status, and changes in magnitude within a range. When the range hood 2 works, the current value increases. When the range hood 2 changes from not working to working, the current has a change limit value which is a set value. The annular current transformer 33 outputs the current of the power line 21 to the electric control board; and when the current is less than the set value, the electric control board determines that the range hood 2 does not work. When the range hood 2 does not work, the motor works and the first air valve 12 is opened; and the first return air inlet 11 returns air indoors. The motor first works to implement indoor air return and circulates the air in the kitchen, and after a preset time, the compressor works to implement refrigeration in the kitchen.

In an embodiment, the step of determining, by the electric control board according to the current of the power line 21 induced by the annular current transformer 33, whether the range hood 2 works includes: determining whether the current induced by the annular current transformer 33 in the set time is greater than or equal to a set value.

The step of controlling, by the electric control board according to whether the range hood 2 works, a working status of the air conditioner 100 includes: if the range hood 2 works, controlling, by the electric control board, the second air valve 14 to open, so that the second return air inlet 13 returns air; and controlling the motor of the air conditioner to work.

In the foregoing embodiment, the annular current transformer 33 outputs the current of the power line 21 to the electric control board; and when the current is greater than the set value, the electric control board determines that the range hood 2 works. When the range hood 2 works, the second return air inlet 13 returns air and the motor works. The second return air inlet 13 introduces outdoor air, and the air in the kitchen is exchanged with the outdoor air, to reduce the air pressure in the kitchen.

After the step of controlling, by the electric control board according to whether the range hood 2 works, a working status of the air conditioner 100, the method includes: acquiring, by the electric control board, the temperature at the second return air inlet 13 measured by the temperature probe 15; and if the temperature at the second return air inlet 13 is less than the set minimum value, controlling, by the electric control board, the compressor to keep in a non-working status.

In the foregoing embodiment, the temperature at the second return air inlet 13 being lower than the set minimum value indicates that the outdoor temperature is lower than the set value. The outdoor air flows in the kitchen by the rotation of the motor and is used for refrigeration to reduce the temperature in the kitchen, without the need to start the compressor for refrigeration and temperature reduction.

In an embodiment, after the step of controlling, by the electric control board according to whether the range hood 2 works, a working status of the air conditioner 100, the method includes: acquiring, by the electric control board, the temperature at the second return air inlet 13 measured by the temperature probe 15; determining whether the temperature at the second return air inlet 13 is between set minimum and maximum values; and if the temperature at the second return air inlet 13 is between the set minimum and maximum values, controlling, by the electric control board after the set time, the compressor of the air conditioner 100 to implement refrigeration.

In the foregoing embodiment, when the range hood 2 works, the second return air inlet 13 returns air and the motor works. The second return air inlet 13 introduces outdoor air, and the air in the kitchen is exchanged with the outdoor air. The temperature measured by the temperature probe 15 is an initial temperature at the second return air inlet 13, namely, the temperature of the introduced outdoor air. The air with the temperature ranging from the two set values cannot reduce the temperature in the kitchen. The motor first works to circulate the air in the kitchen and the outdoor air. After 3 min, the electric control board controls the compressor of the air conditioner to implement refrigeration, so as to reduce the temperature in the kitchen.

In an embodiment, after the step of controlling, by the electric control board according to whether the range hood 2 works, a working status of the air conditioner 100, the method includes: acquiring, by the electric control board, the temperature at the second return air inlet 13 measured by the temperature probe 15; determining whether the temperature at the second return air inlet 13 is greater than a maximum value; and if the temperature at the second return air inlet 13 is greater than the maximum value, controlling, by the electric control board, the second air valve 14 to close and the first air valve 12 to open, so that the first return air inlet 11 returns air; and after a set time, controlling, by the electric control board, the compressor of the air conditioner to implement refrigeration.

In the foregoing embodiment, the outdoor air introduced through the second return air inlet 13 has a high temperature, which cannot lower the temperature in the kitchen, but on the contrary, may increase the temperature in the kitchen. The second air valve 14 is closed to no longer introduce the outdoor air. Then, the first return air inlet 11 returns air to circulate the air in the kitchen, and the compressor works to implement refrigeration so as to reduce the temperature in the kitchen.

The set value of the current is 0.2 A, the set minimum value of the temperature is 16° C., and the set maximum value of the temperature is 40° C.

In the foregoing embodiment, a low current passes through the power line 21 in a power-on status and increases during passing through the power line 21. When the current passing through the power line 21 is higher than 0.2 A, it indicates that the range hood 2 works. The set maximum and minimum temperature values indicate the temperature at the second air valve 14, namely, the temperature of the outdoor air that enters the second air valve 14; and the inlet air has a temperature lower than 16° C. The air with the temperature below 16° C. enters the kitchen, and the outdoor air flows in the kitchen by the rotation of the motor to implement refrigeration. The outdoor air with the temperature higher than 16° C. and lower than 40° C. cannot enter the kitchen only by the rotation of the motor for temperature reduction. The inlet air entering from the outside with the temperature higher than 40° C. cannot lower the temperature in the kitchen, but on the contrary, may increase the workload of the compressor.

The above merely describes preferred embodiments of the present invention, and does not limit the patent protection scope of the present invention. Any equivalent structures or process transformations made by using the specification and the accompanying drawings of the present invention can be applied directly or indirectly in other related technical fields, and all fall within the patent protection scope of the present invention.

What is claimed is:

1. A control method for a kitchen air conditioner in a kitchen equipped with a range hood, the kitchen air conditioner comprising:

a housing, in which an electric control board is disposed wherein a return air inlet, is provided on the housing, and comprises a first return air inlet and a second return air inlet; the first return air inlet is used for the air that enters the kitchen, and the second return air inlet leads to the outside of the kitchen through an air duct and is used for introducing the outdoor air; wherein a first air valve is disposed in the first return air inlet and is electrically connected to the electric control board; a second air valve is disposed in the second return air inlet and is electrically connected to the electric control board; a temperature measurement device for measuring the temperature at the second return air inlet is disposed on a sidewall of the second return air inlet, and is electrically connected to the electric control board; and the temperature measurement device is a temperature probe; and the air conditioner comprises a current detection device disposed outside the housing and electrically connected to the electric control board, wherein the current detection device is used for detecting a current of the range hood and determining whether the range hood works, and wherein the current detection device is an annular current transformer sleeved on a power line of the range hood, wherein the control method comprises:

when the air conditioner stands by, controlling, by the electric control board, the first air valve and the second air valve to close;

acquiring, by the electric control board, a current of the power line of the range hood that is induced by the annular current transformer in a set time;

determining, by the electric control board according to the current of the power line induced by the annular current transformer, whether the range hood works by determining whether the current induced by the annular current transformer in the set time is less than a set value and determining that the range hood does not work in response to the current being less than the set value; and controlling, by the electric control board according to whether the range hood works, a working status of the air conditioner, wherein the controlling comprises, controlling, by the electric control board, the first air valve to open in response to the range hood not working, so that the first return air inlet returns air; and controlling a motor of the air conditioner to work and a compressor of the air conditioner to implement refrigeration after a preset time.

2. The control method of a kitchen air conditioner according to claim 1, wherein the step of determining, by the electric control board according to the current of the power line induced by the annular current transformer, whether the range hood works comprises:

determining whether the current induced by the annular current transformer in the set time is greater than or equal to a set value; and determining that the range hood works in response to the determining;

the step of controlling, by the electric control board according to whether the range hood works, a working status of the air conditioner comprises:

controlling, by the electric control board, the second air valve to open in response to the range hood working, so that the second return air inlet returns air; and controlling the motor of the air conditioner to work.

3. The control method of a kitchen air conditioner according to claim 2, wherein after the step of controlling, by the electric control board according to whether the range hood works, a working status of the air conditioner, the method comprises:

acquiring, by the electric control board, the temperature at the second return air inlet measured by the temperature probe;

determining whether the temperature at the second return air inlet is less than a set minimum value; and controlling, by the electric control board, a compressor to keep in a non-working status in response to the temperature at the second return air inlet being less than the set minimum value.

4. The control method of a kitchen air conditioner according to claim 2, wherein after the step of controlling, by the electric control board according to whether the range hood works, a working status of the air conditioner, the method comprises:

acquiring, by the electric control board, the temperature at the second return air inlet measured by the temperature probe;

determining whether the temperature at the second return air inlet is between set minimum and maximum values; and controlling, by the electric control board after a set time, a compressor of the air conditioner to implement refrigeration in response to the temperature at the second return air inlet being between the set minimum and maximum values.

5. The control method of a kitchen air conditioner according to claim 2, wherein after the step of controlling, by the electric control board according to whether the range hood works, a working status of the air conditioner, the method comprises:

acquiring, by the electric control board, the temperature at the second return air inlet measured by the temperature probe;

determining whether the temperature at the second return air inlet is greater than a set maximum value; and controlling, by the electric control board, the second air valve to close and the first air valve to open in response to the temperature at the second return air inlet being greater than the maximum value, so that the first return air inlet returns air; and after a set time, controlling, by the electric control board, a compressor of the air conditioner to implement refrigeration.

6. A system comprising a kitchen air conditioner and a range hood, the air kitchen conditioner comprising:

a housing, in which an electric control board is disposed, wherein a return air inlet is provided on the housing of the air conditioner, and comprises a first return air inlet and a second return air inlet; the first return air inlet is used for the air that enters the kitchen, and the second return air inlet is configured to lead to the outside of the kitchen through an air duct and is for introducing the outdoor air; wherein a first air valve is disposed in the first return air inlet and is electrically connected to the electric control board; a second air valve is disposed in the second return air inlet and is electrically connected to the electric control board; a temperature measurement device for measuring the temperature at the second return air inlet is disposed on a sidewall of the second return air inlet, and is electrically connected to the electric control board; and the temperature measurement device is a temperature probe; and a current detection device disposed outside the housing and electrically connected to the electric control board, wherein the current detection device is for detecting a current of the range hood and determining whether the range hood works, and wherein the current detection device is an annular current transformer sleeved on a power line of the range hood, wherein the electric control board is configured to carry out the method of claim 1 in order to control a working status of the air conditioner according to whether the range hood works.

* * * * *